United States Patent [19]

Scarpa et al.

[11] 4,195,449

[45] Apr. 1, 1980

[54] PORTABLE CUTTING-TOOL SHARPENER

[76] Inventors: Annamaria Scarpa; Franco Zanobini, both of Via Mameli 25, San Vincenzo, Italy

[21] Appl. No.: 956,003

[22] Filed: Oct. 30, 1978

Related U.S. Application Data

[63] Continuation of Ser. No. 768,317, Feb. 14, 1977, abandoned.

[30] Foreign Application Priority Data

Apr. 6, 1976 [IT] Italy ..... 17406 A/76

[51] Int. Cl.[2] ..... B24B 23/06

[52] U.S. Cl. ..... 51/170 EB

[58] Field of Search ..... 51/170 EB, 170 R, 270, 51/135 R

[56] References Cited

U.S. PATENT DOCUMENTS

| | | | |
|---|---|---|---|
| 1,665,676 | 4/1928 | Primeaux | 51/170 EB |
| 1,773,077 | 8/1930 | Newman | 51/170 EB |
| 2,055,351 | 9/1936 | Hormel | 51/170 EB |
| 2,423,287 | 7/1947 | Beisel | 51/270 |
| 3,983,664 | 10/1976 | Martin | 51/170 EB |

FOREIGN PATENT DOCUMENTS

| | | | |
|---|---|---|---|
| 249446 | 4/1948 | Switzerland | 51/170 EB |

*Primary Examiner*—Othell M. Simpson
*Assistant Examiner*—Roscoe V. Parker
*Attorney, Agent, or Firm*—Beveridge, De Grandi, Kline & Lunsford

[57] ABSTRACT

A portable cutting-tool sharpener comprising a compact housing of the box-type, having a central enlarged portion and two aligned, straight sections extending from the opposite sides of the enlarged portion; two parallel frame plates secured in one of the aligned straight housing sections; electric motor received in the enlarged housing portion; a first pulley keyed to the shaft of the electric motor means; a second pulley keyed to a driving roller journalled between the parallel plates, adjacent to the electric motor means; a driving "V-belt" connecting the first and second pulleys and an idle roller journalled on a fork slidingly supported between the parallel plates at the ends thereof remote from the electric motor means; and an endless abrasive band mounted around the idle roller and the driving roller and driven by the latter, arranged longitudinally between the parallel frame plates; at least a length of the endless abrasive band being exposed to allow sharpening of cutting tools by the moving endless abrasive band, upon excitation of the electric motor.

5 Claims, 2 Drawing Figures

1
2
3
4
5
6
7
8
9
10
11
12
13
14
15
16
18
19
20
21
22
23
24

PORTABLE CUTTING-TOOL SHARPENER

This is a continuation of application Ser. No. 768,317, filed Feb. 14, 1977, now abandoned.

This invention relates to a portable cutting-tool sharpener.

There is at present a wide and increasing demand for a portable, compact and efficient apparatus for sharpening the cutting members of cutting tools in a quick and easy way.

Accordingly, it is a main object of the invention to provide a portable sharpener that is compact, sturdy and highly efficient, thus easily available for sharpening the cutting members of cutting tools without taking the latter from the working place.

This object is attained by a sharpener comprising a compact box-type housing having a central enlarged portion and two aligned, straight sections extending from the opposite sides thereof; an electric motor, received in the enlarged portion; and an endless abrasive band supported around two rotary rollers, the adjacent roller being driven by the electric motor and the remote roller being idly supported on the end of the housing upper section, which receiver therein the endless abrasive band.

A portion of two opposite walls of the upper section is removed to expose a corresponding length of the endless abrasive band to allow the cutting member to be sharpened by the abrading action of the abrasive surface of the endless abrasive band.

The characteristics of the abrasive band are chosen according to the different uses of the sharpener.

The sharpener of the invention will be now more particularly described with reference to the annexed drawing, wherein.

Figures 1, 2:
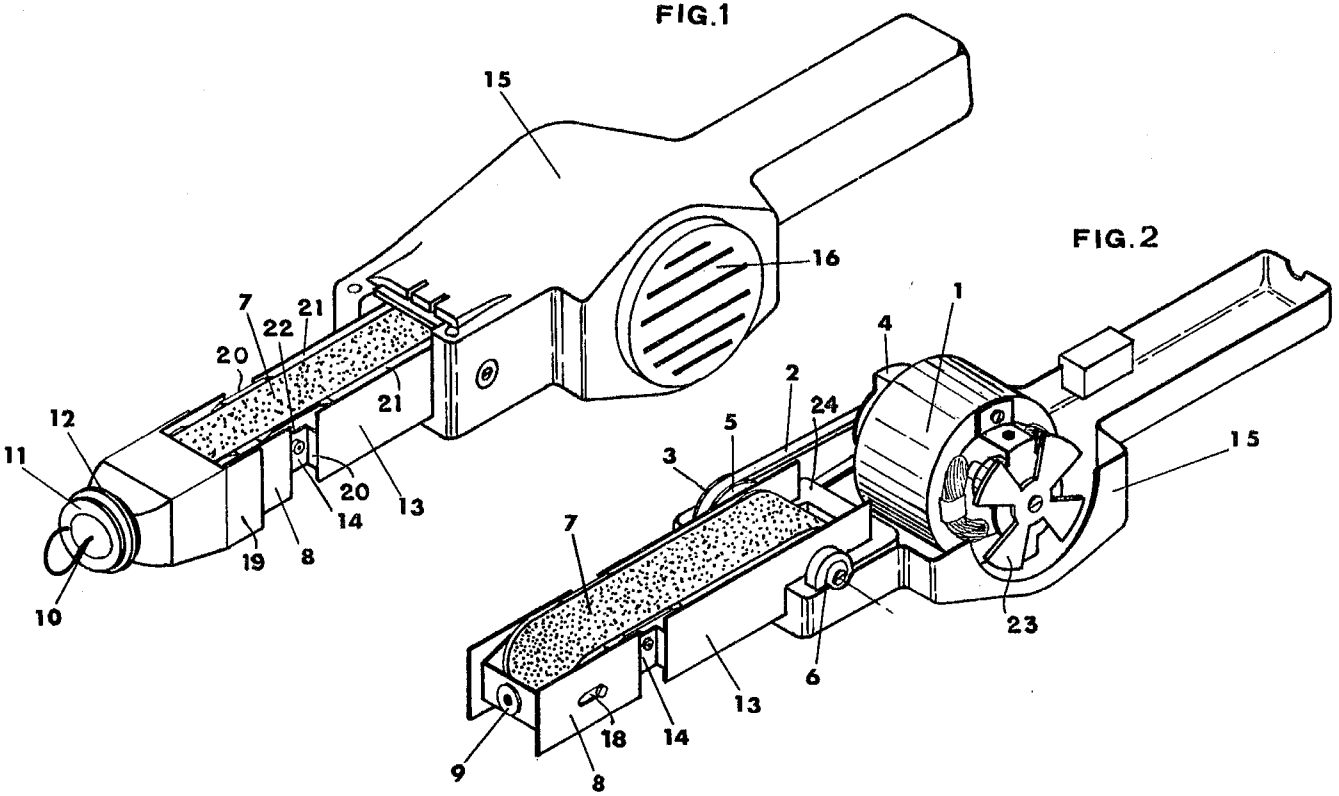
FIG. 1 is a perspective view of the sharpener.
FIG. 2 is a similar view with a portion of the sharpener housing removed to show the inner structure thereof.

The electric motor 1 of the sharpening apparatus is received in the central enlarged portion 15 of the box-type housing and it drives an axle 3 through a "V" belt 2 running around a first pulley 4, keyed to the electric motor shaft (not shown) and a second pulley 5, keyed to axle 3. Pulleys 4 and 5 have diameters such as to drive axle 3 at a reduced speed in respect of motor 1.

Axle 3 is journalled on a coupled of shielded ball-bearings 6 and a drive roller (not shown) is keyed thereto for driving endless abrasive band 7, which is tensioned by an idle roller (not shown). The idle roller is journalled on a metallic fork 8 having a central threaded hole 9.

The threaded stem of a hock 10, having a disk 11 fastened thereto, is threaded into central threaded hole 9 of fork 8, which fork is slidingly received by two parallel plates 13 by means of longitudinally extending slots 18; plates 13 being secured to housing 15. As viewed in FIG. 1, hook 10 and disk 11 are arranged externally of end cover 19 of the housing upper section, and disk 11 is provided with an outer rubber ring 12.

Finally, each plate 13 has a channel-like section 20 slidably receiving a slide 14, the upper edges of which can be used as bearing members for the cutting members to be sharpened, as fully described later on.

In the operation, motor 1 is actuated by suitably connecting the same to the electrical current network, as through a connection cable (not shown), and rotation thereof is transmitted to axle 3 through pulley 4, "V" belt 2 and pulley 5.

Consequently, endless abrasive band 7 is driven around the drive roller and idle roller and any cutting member, as a blade, can be easily and quickly sharpened using as a bearing plane that plane formed by edges 21 of plates 13, that are flush with the abrading surface of abrasive band 7.

Where a special sharpening is required, such as a right angle sharpening, use is made of slides 14, the free edges 22 of which can define a plane raised above the abrading surface plane, through a sliding movement of slides 14 in channel-like sections 20 13. The vertical edges of slides 14 extending above band 7 then provide a surface against which the end of the tool can be braced to assure that the sharpened edge remains at a right angle to the body of the tool. Rounded sharpening can be obtained with edges 12 lowered in the area beneath this raised plane.

The right tension of endless abrasive band 7 is achieved by suitably rotating disk 11 in clockwise or counterclockwise direction, as such rotations cause fork 8 to translate in one or the other direction of plates 13, due to the threaded stem of hook 10 engaged into threaded hole 9 of fork 8.

Moreover, hook 10 can be used to hang the apparatus when not on operation, while rubber ring 12 acts as a bearing member when the apparatus is operated.

As further details, the drive roller is preferably made of aluminium, while housing 15 is preferably moulded from a suitable plastic material.

Furthermore, two or more permanent magnets 24 can be used to attract the small steel chips removed by the sharpening action of the abrasive band.

Finally, the enlarged portion of housing 15 is closed by two covers 16 that can be easily removed for maintenance or substitution purposes, covers 16 being slotted to allow the cooling air flow, produced by fan 23, to cool motor 1, which motor is preferably a single-phase electric motor provided with brushes.

We claim:

1. A portable cutting-tool sharpener, for sharpening cutting members of cutting tools, comprising a box-type housing having an enlarged central portion and two aligned straight sections extending from opposite sides of said central portion; motor means within said central portion and including a driven roller; a pair of spaced, parallel frame plates secured to one of said straight sections to define a channel having a longitudinal axis; a fork member movably connected to said frame plates and movable parallel to said longitudinal axis; an idler roller supported by said fork member; an endless band having an abrasive surface and mounted by said idler roller and said driven roller to be driven by said driven roller in the direction of the longitudinal axis; a pair of slide members within said channel and slidably mounted on said frame plates for sliding movement between a first position, in which said slide members extend above the plane of said abrasive surface with one edge of a first one of said pair of slide members cooperating with one edge of the other of said pair of slide members to define a plane providing support for a cutting tool during sharpening of the cutting member thereof, and a second position, in which said cooperating edges of said slide members are beneath the plane of said abrasive surface; said abrasive surface being exposed adjacent said slide members to allow the cutting member of a cutting tool to be sharpened by the abrasive surface of the moving endless band upon excitation of said motor means.

2. A cutting-tool sharpener as claimed in claim 1 in which said fork member has a central threaded hole, said sharpener further comprising a hook member having a disk portion and a threaded stem adapted to engage the threaded hole; and an end cover having a hole and adapted for positioning over said fork member with said threaded stem passing through the end cover hole and threadedly engaged in the fork member threaded hole.

3. A cutting-tool sharpener as claimed in claim 1 in which each of said frame plates has a free edge flush with the abrading surface of said endless abrasive band to form a bearing surface for a cutting tool being sharpened by said endless abrasive band.

4. A cutting-tool sharpener as claimed in claim 1 further comprising a permanent magnet adjacent said endless abrasive band for attracting steel chips produced by the sharpening action on cutting members.

5. A cutting-tool sharpener as claimed in claim 1 in which said central portion includes a cover member having slots therethrough and a fan operated by said motor means for causing air to flow through the slots to cool said motor.

* * * * *